US008348116B2

(12) United States Patent
Xu

(10) Patent No.: US 8,348,116 B2
(45) Date of Patent: Jan. 8, 2013

(54) NAIL GUN ADAPTABLE TO NAILS OF DIFFERENT LENGTH

(76) Inventor: Jun-Xiu Xu, Dashu Township, Kaohsiung County (TW)

( * ) Notice: Subject to any disclaimer, the term of this patent is extended or adjusted under 35 U.S.C. 154(b) by 254 days.

(21) Appl. No.: 12/960,553

(22) Filed: Dec. 6, 2010

(65) Prior Publication Data

US 2012/0138656 A1 Jun. 7, 2012

(51) Int. Cl.
*B25C 1/00* (2006.01)

(52) U.S. Cl. ..... 227/109; 227/142

(58) Field of Classification Search ..... 227/109, 227/142

See application file for complete search history.

(56) References Cited

U.S. PATENT DOCUMENTS 4,014,488 A * 3/1977 Potucek et al. ..... 226/6
4,404,877 A * 9/1983 Mizuno et al. ..... 81/57.37
5,109,738 A * 5/1992 Farian et al. ..... 81/434
5,167,174 A * 12/1992 Fujiyama et al. ..... 81/434
5,437,404 A * 8/1995 Shkolnikov ..... 227/109
5,473,965 A * 12/1995 Chen ..... 81/434
5,687,624 A * 11/1997 Tsuge et al. ..... 81/439
5,988,026 A * 11/1999 Reckelhoff et al. ..... 81/434
6,705,501 B2 * 3/2004 Miller et al. ..... 227/8
7,032,482 B1 * 4/2006 Hoffman ..... 81/434
7,134,367 B2 * 11/2006 Gehring et al. ..... 81/434
7,454,996 B2 * 11/2008 Hsu ..... 81/57.37
7,461,574 B2 * 12/2008 Lewis et al. ..... 81/57.37
7,997,171 B2 * 8/2011 Massari et al. ..... 81/434
2004/0245312 A1 * 12/2004 Miller et al. ..... 227/142
2005/0040204 A1 * 2/2005 Chi ..... 227/109
2008/0216607 A1 * 9/2008 Xu ..... 81/52
2008/0289458 A1 * 11/2008 Xu ..... 81/434

* cited by examiner

*Primary Examiner* — Brian D Nash
(74) *Attorney, Agent, or Firm* — Leong C. Lei

(57) ABSTRACT

The nail gun contains a gun body and an adjustment device. The gun body has a base containing a top opening. The adjustment device is mounted on the base, and contains a sliding member and a positioning member. The sliding member contains two opposing elongated wing pieces extended along the two lateral sides of the base, respectively. Each wing piece has a through slot, and each slot has a number of positioning notches along a top side of the slot. The positioning member contains a positioning element and an elastic element. The positioning element is housed in the base and is exposed out of the top opening. The positioning element also contains at least a positioning bar extended out of the base into a slot to engage the positioning notches. The elastic element has its two ends connected to the positioning element and the base.

3 Claims, 6 Drawing Sheets

NAIL GUN ADAPTABLE TO NAILS OF DIFFERENT LENGTH

TECHNICAL FIELD OF THE INVENTION

The present invention generally relates to nail guns or nailers, and especially relates to a nail gun adjustable to work with nails of different length.

DESCRIPTION OF THE PRIOR ART

A conventional nail gun as shown in FIG. 7 contains a gun body 90 having a guiding rail, and an adjustment device 80 on the gun body 90. The adjustment device 80 contains a main member 81 having two opposing and backward-extending wing pieces 82 along the two lateral sides of the gun body 90. Each wing piece 82 has a through slot 83 with a circumferential wall 85. Along each circumferential wall 84, a number of inwardly slant, wave-like notches 84 are provided. The adjustment device 80 is joined to the gun body 90 by applying at least a bolt 86 through a slot 83 of the main member 81, and the adjustment device 80 is locked by driving the bolt 86's cap 87 tightly against the inner wall 85.

In order to accommodate nails of different length, the position of the adjustment device 80 has to be adapted accordingly. To achieve this, the bolts 86 are loosened, and the main member 81 and its wing pieces 82 are free to move back and forth along the gun body 90 until reaching a desired position. Then, the bolts 86 are fastened again to lock the adjustment device 80.

Whenever nails of a different length to be used, the foregoing procedure has to be repeated again, which is inconvenient and time-consuming.

SUMMARY OF THE INVENTION

The major objective of the present invention is to provide a nail gun easily and conveniently adaptable to accommodate nails of different length.

To achieve this objective, the nail gun of the present invention contains a gun body and an adjustment device.

The gun body contains a guiding rail for loading and holding clips of nails and a base at a top end of the guiding rail. The base contains a top opening on a top side and two side openings on two lateral sides, respectively.

The adjustment device is mounted on the base, and contains a sliding member and a positioning member. The sliding member is slidable back and forth along the base. The sliding member contains two opposing elongated wing pieces extended along the two lateral sides of the base, respectively. Each wing piece has a through slot, and each slot has a number of positioning notches along a top side of the slot. The positioning member contains a positioning element and an elastic element. The positioning element is housed in the base and is exposed out of the top opening. The positioning element also contains at least a positioning bar extended out of the base into a slot to engage the positioning notches. The elastic element has its two ends connected to the positioning element and the base.

By depressing the positioning element, the elastic element is compressed and the positioning bar is moved out of the confinement of a positioning notch. The sliding member then could be slid along the base until an appropriate position matching the nail length is reached. After the adjustment described above is completed, by releasing the pressure on the positioning element, the elastic element is released and the positioning bar is moved into a positioning notch at the desired position, thereby positioning the sliding member on the base again.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

Figure 1:
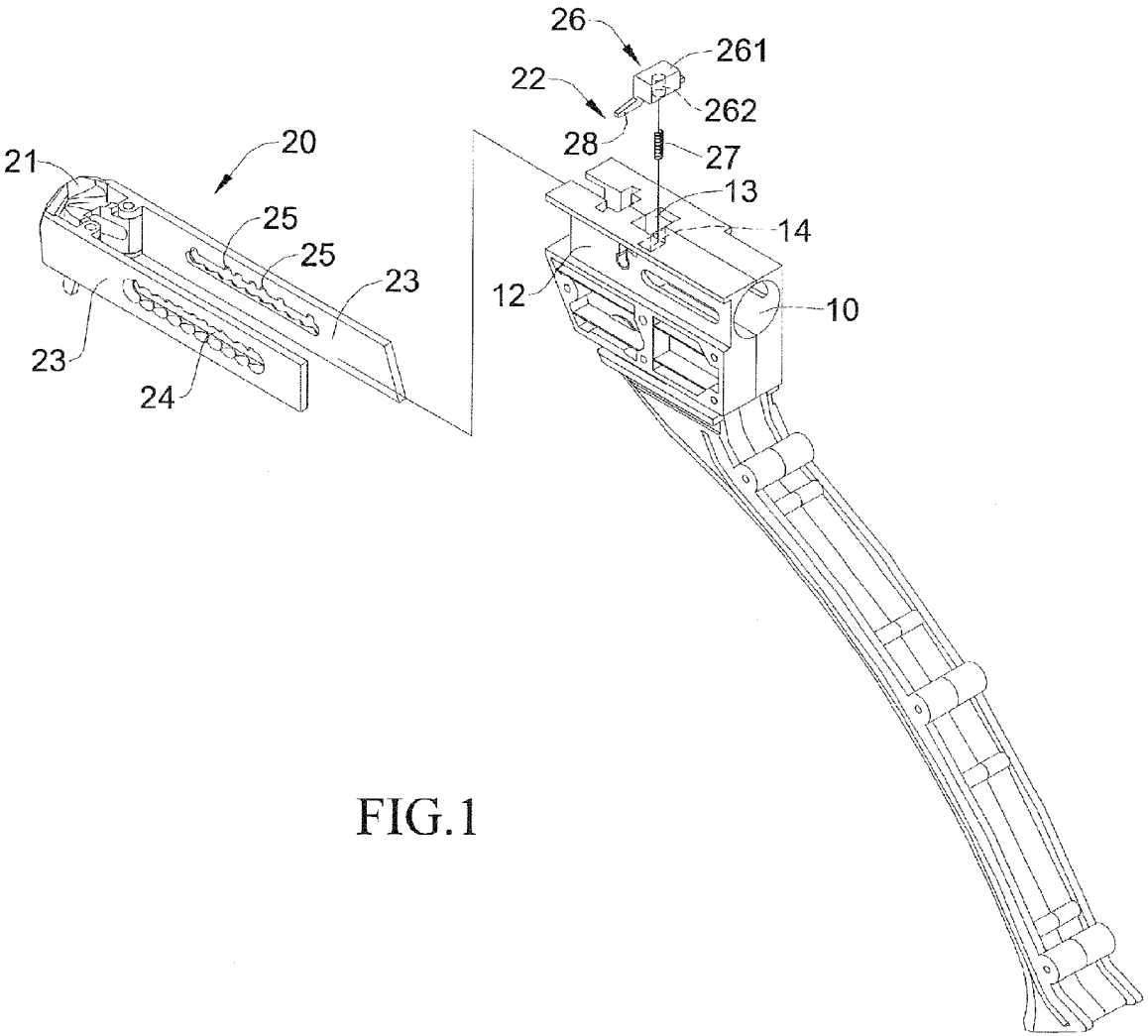
FIG. 1 is a perspective break-down diagram showing the various components of a nail gun according to an embodiment of the present invention.
Figure 2:
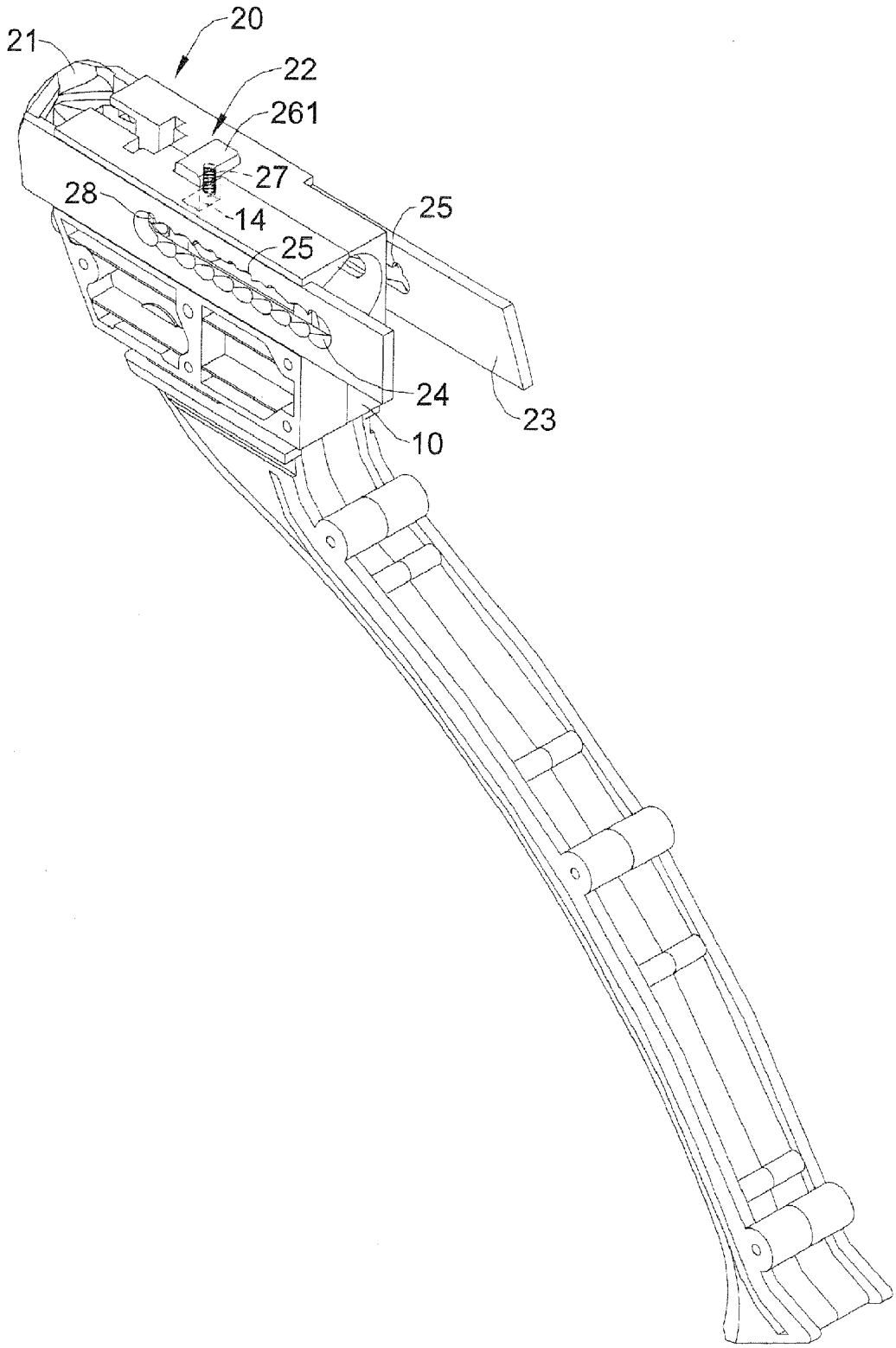
FIG. 2 is a perspective diagram showing the nail gun of FIG. 1 after its assembly.
Figure 3:
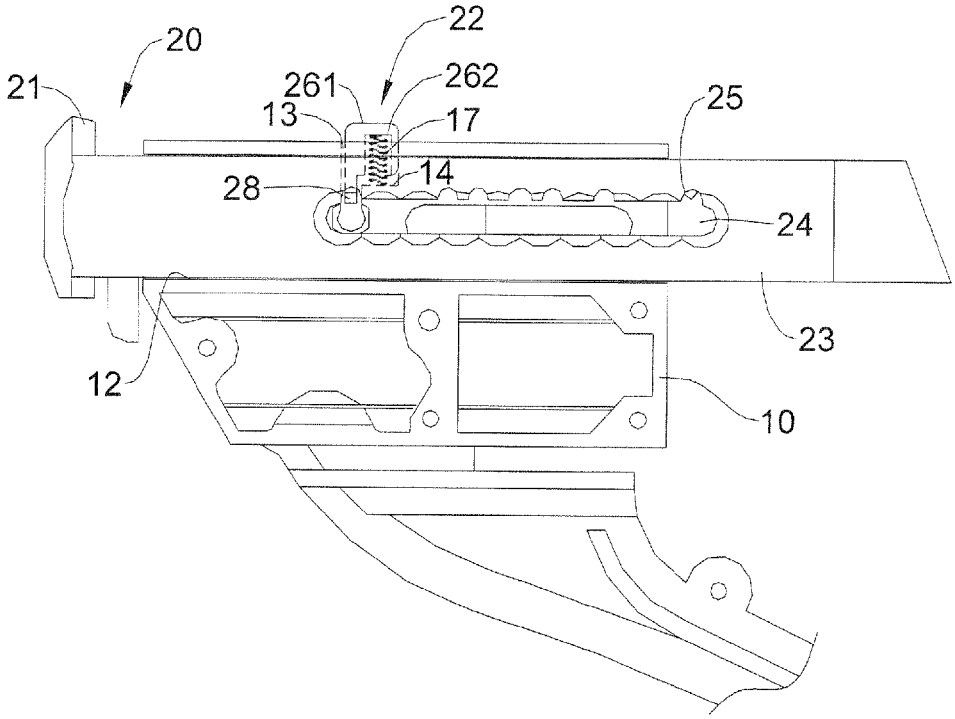
FIG. 3 is a partial side-view diagram showing the nail gun of FIG. 1.
Figure 4:
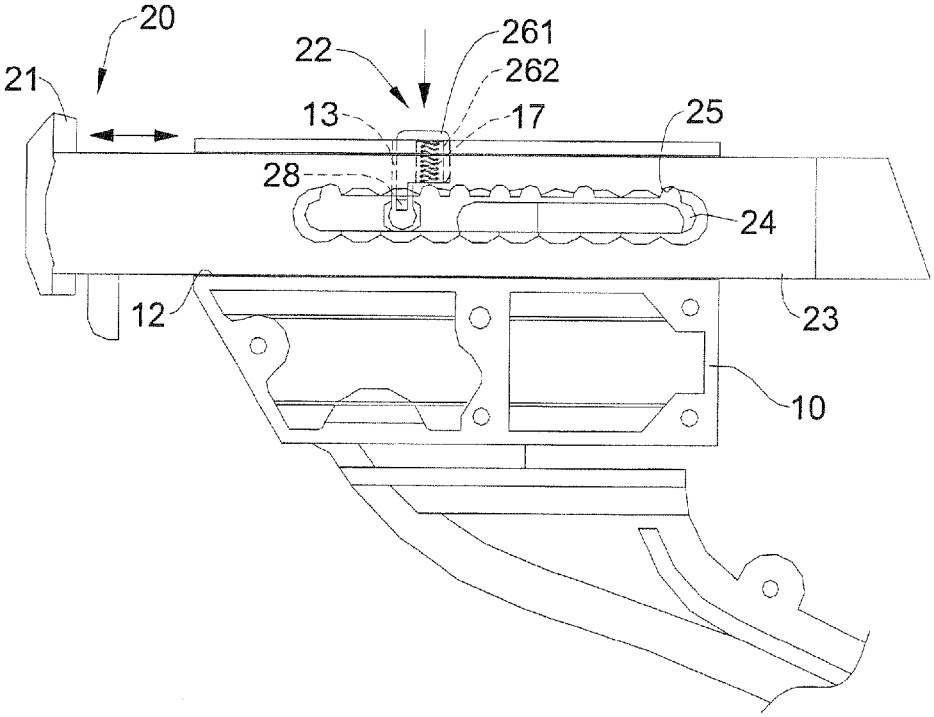
FIGS. 4 and 5 are partial side-view diagrams showing the scenario of adjusting the nail gun of FIG. 3.
Figure 5:
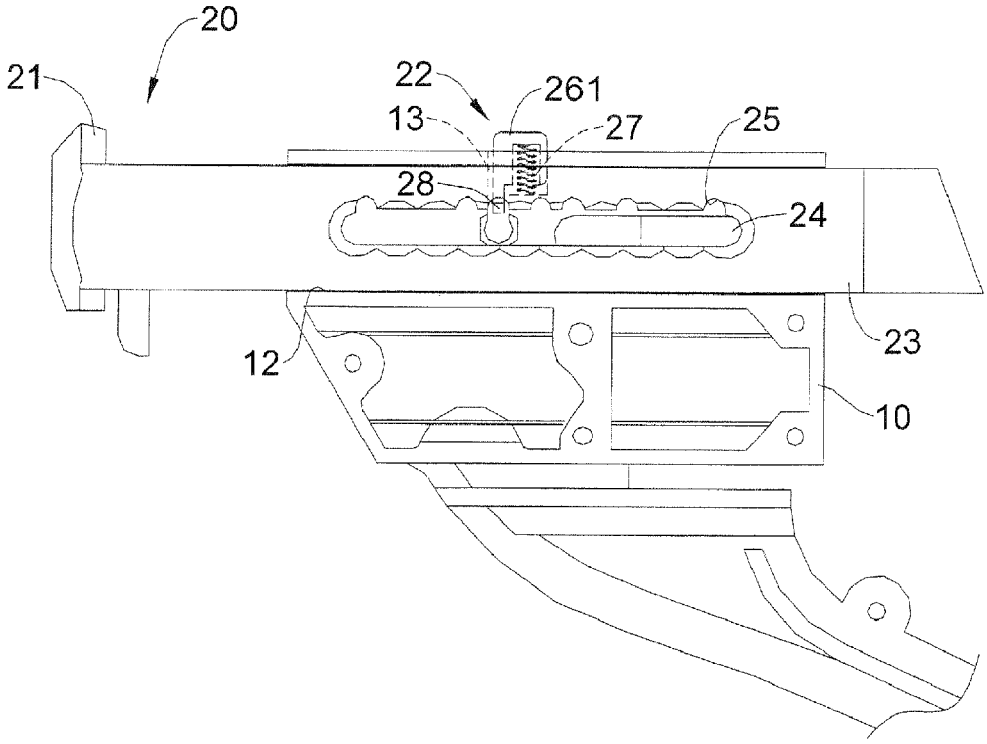

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

As shown in FIGS. 1 to 6, a nail gun according to an embodiment of the present invention mainly contains a gun body 10 and an adjustment device 20.

The gun body 10 contains a guiding rail 11 for loading and holding clips of nails 30 and a base 12 at a top end of the guiding rail 11. The base 12 has a through channel connecting a front end and a back end of the base 12. The base 12 further contains a top opening 13 on a top side and two side openings on two lateral sides, respectively, all leading to the channel.

The adjustment device 20 is mounted on the base 12, and contains a sliding member 21 and a positioning member 22. The sliding member 21 is slidable back and forth along the base 12. The sliding member 21 contains two opposing elongated wing pieces 23 extended along the two lateral sides of the base 12, respectively. Each wing piece 23 has a through slot 24, and each slot 24 has a number of positioning notches 25 along a top side of the slot 24. The positioning member 22 contains a positioning element 26 and an elastic element 27. The positioning element 26 is housed in the base 12 and is exposed out of the top opening 13. The positioning element

26 also contains at least a positioning bar 28 extended out of the base 12 into a slot 24 to engage the positioning notches 25. The elastic element 27 has its two ends connected to the positioning element 26 and the base 12.

Preferably, the positioning element 26 contains a profusion 261 where two positioning bars 28 are extended outward from two opposing sides of the protrusion 261. A block 14 is provided in the channel of the base 12. A groove 262 is provided on the side of the protrusion 261 facing the block 14. The elastic element 27 has an end against the block 14 and the other end extended into the groove 262 against the protrusion 261.

Figure 6:
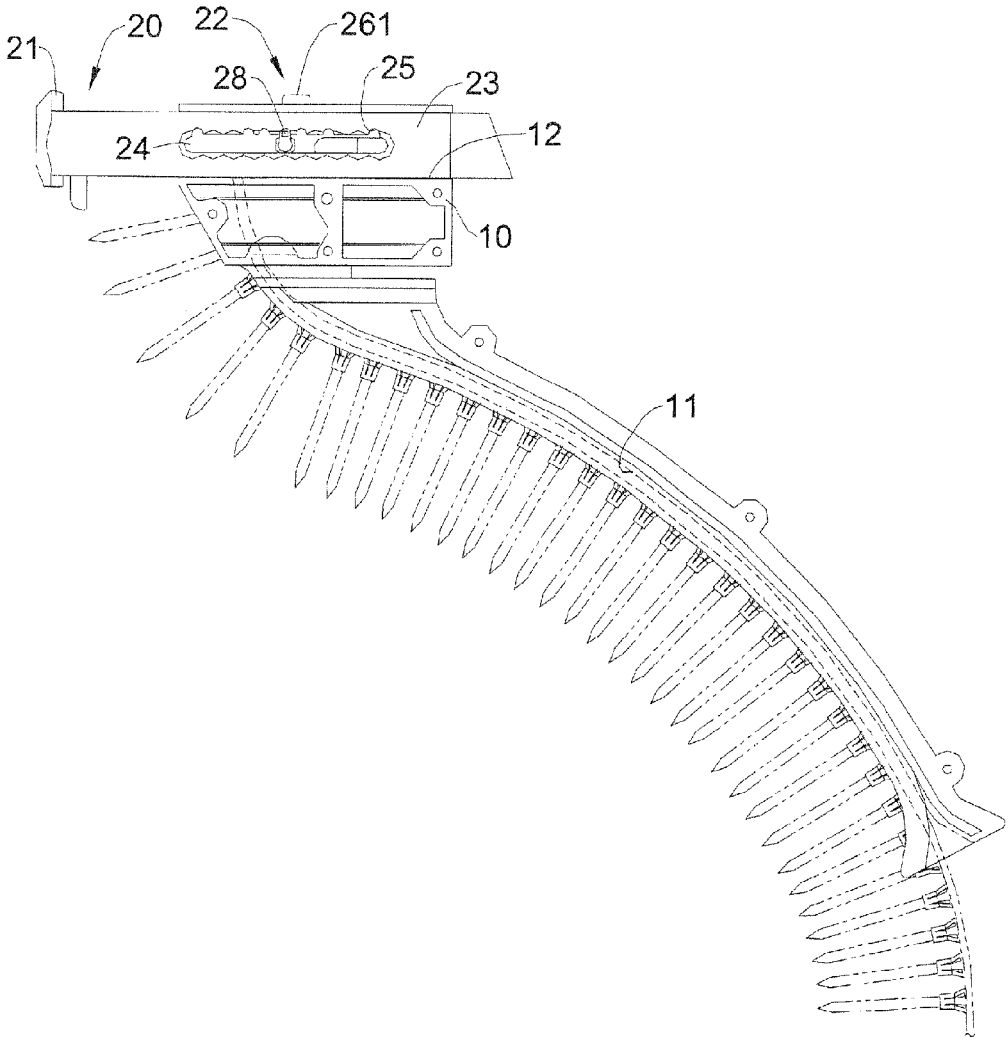
FIG. 6 is a side view diagram showing the nail gun of FIG. 1 with clips of nails loaded.
Figure 7:
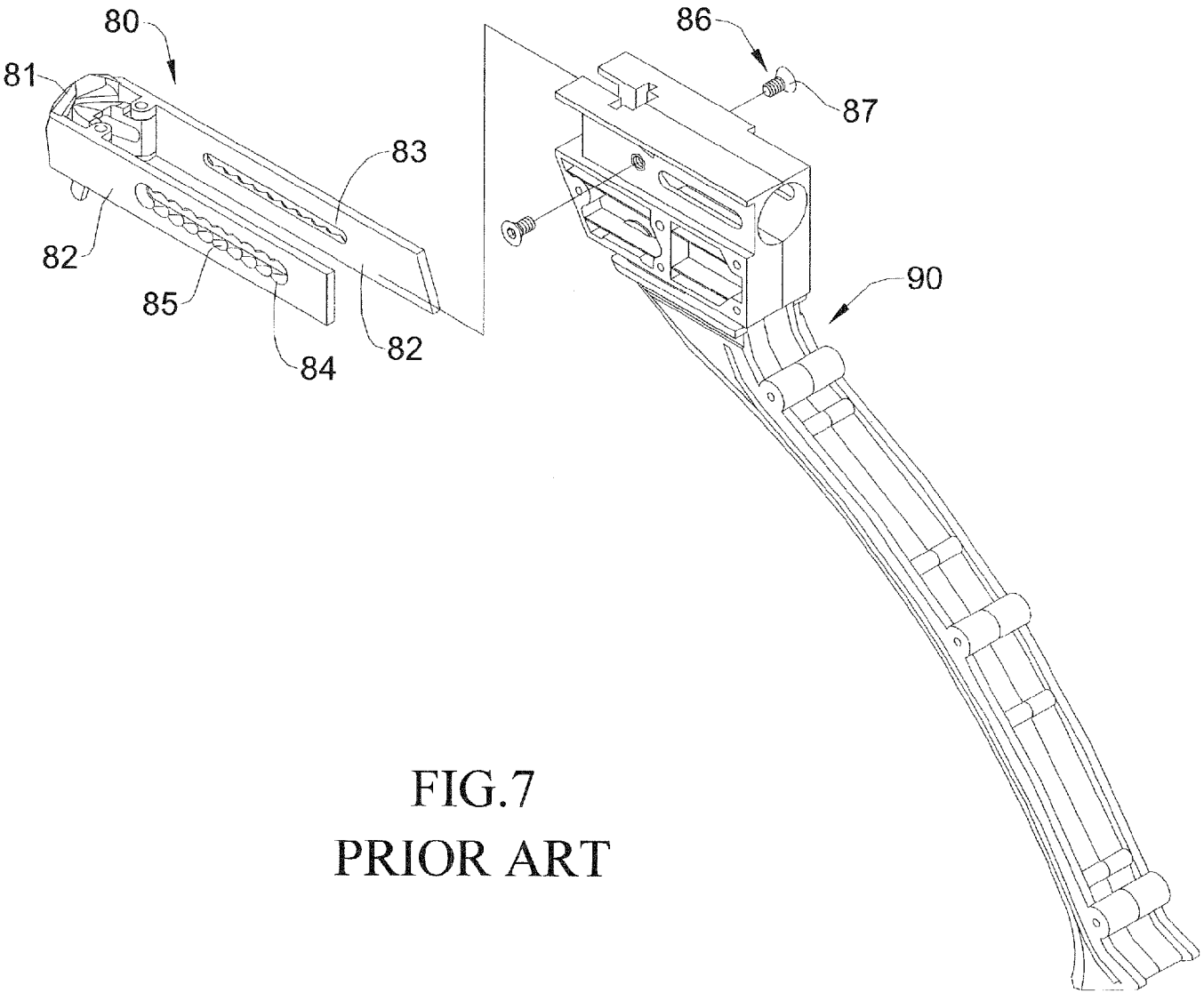
FIG.7 PRIOR ART
FIG. 7 is a perspective break-down diagram showing a conventional nail gun.

As shown in FIG. 6, clips of nails 30 are loaded into the guiding rail 11. Depending on the length of the nails 30, the sliding member 21 has to be adjusted accordingly. By depressing the positioning element 26, the elastic element 27 is compressed and the positioning bar 28 is moved out of the confinement of a positioning notch 25. The sliding member 21 then could be slid along the base 12 until an appropriate position matching the nail length is reached. After the adjustment described above is completed, by releasing the pressure on the positioning element 26, the elastic element 27 is released and the positioning bar 28 is moved into a positioning notch 25 at the desired position, thereby positioning the sliding member 21 on the base 12 again.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A nail gun, comprising a gun body and an adjustment device wherein said gun body contains a guiding rail for loading and holding clips of nails and a base at a top end of said guiding rail; said base has a through channel connecting a front end and a back end of said base, and contains a top opening on a top side and two side openings on two lateral sides, respectively, all leading to said channel; and said adjustment device is mounted on said base, and contains a sliding member and a positioning member; said sliding member is slidable back and forth along said base; said sliding member contains two opposing elongated wing pieces extended along two lateral sides of said base, respectively; each wing piece has a through slot, and each slot has a plurality of positioning notches along a top side of said slot; said positioning member contains a positioning element and an elastic element; said positioning element is housed in said base and is exposed out of said top opening; said positioning element also contains at least a positioning bar extended out of said base into a slot to engage said positioning notches; said elastic element has its two ends connected to said positioning element and said base.

2. The nail gun according to claim 1, wherein said positioning element contains a protrusion where two positioning bars are extended outward from two opposing sides of said protrusion.

3. The nail gun according to claim 2, wherein a block is provided in said channel of said base; a groove is provided on a side of said protrusion facing said block; said elastic element has an end against said block and the other end extended into said groove against said protrusion.

* * * * *